US006582274B1

(12) United States Patent
Chernek et al.

(10) Patent No.: US 6,582,274 B1
(45) Date of Patent: Jun. 24, 2003

(54) NOISE MAKING TOY

(75) Inventors: Daniel A. Chernek, Ambler, PA (US); Michael P. Kind, Maple Glen, PA (US)

(73) Assignee: Basic Fun, Inc., Southampton, PA (US)

( * ) Notice: Subject to any disclaimer, the term of this patent is extended or adjusted under 35 U.S.C. 154(b) by 0 days.

(21) Appl. No.: 09/559,810

(22) Filed: Apr. 26, 2000

(51) Int. Cl.[7] ..... A63H 5/00

(52) U.S. Cl. ..... 446/397; 446/197; 446/267; 446/188

(58) Field of Search ..... 446/397, 188, 446/180, 184, 183, 186, 192, 193, 197, 267; 482/108

(56) References Cited

U.S. PATENT DOCUMENTS

| | | | | | |
|---|---|---|---|---|---|
| 2,589,757 | A | * | 3/1952 | Williams | 40/406 |
| 2,668,394 | A | * | 2/1954 | Auzin | 222/78 |
| 3,334,899 | A | * | 8/1967 | Bosko et al. | 446/267 |
| 3,601,923 | A | * | 8/1971 | Rosenberg | 297/DIG. 1 |
| 4,040,619 | A | | 8/1977 | Landi | 272/68 |
| 4,160,338 | A | | 7/1979 | Lyons et al. | 46/44 |
| 4,560,392 | A | | 12/1985 | Basevi | 446/186 |
| 4,695,051 | A | * | 9/1987 | Jenison | 482/108 |
| 4,917,645 | A | | 4/1990 | Amici et al. | 446/184 |
| 4,929,211 | A | * | 5/1990 | Resnick et al. | 446/14 |
| 4,952,190 | A | * | 8/1990 | Tarnoff et al. | 446/267 |
| 5,006,089 | A | * | 4/1991 | Lee | 428/100 |
| 5,205,773 | A | * | 4/1993 | Koepcke et al. | 124/64 |
| 5,258,068 | A | | 11/1993 | Shapero et al. | 106/208 |
| 5,310,421 | A | | 5/1994 | Shapero et al. | 106/208 |
| 5,431,615 | A | * | 7/1995 | Correll | 446/267 |
| 5,433,644 | A | * | 7/1995 | Cheng | 446/183 |
| 5,445,587 | A | * | 8/1995 | Brown | 482/108 |
| 5,540,720 | A | * | 7/1996 | Ortega | 446/267 |
| 5,571,037 | A | | 11/1996 | Sellers | 446/188 |
| 5,577,723 | A | | 11/1996 | DiResta et al. | 273/58 H |
| 5,647,809 | A | * | 7/1997 | Yip | 446/220 |
| 5,749,799 | A | * | 5/1998 | Jasperson | 473/594 |
| 5,769,682 | A | | 6/1998 | DiResta et al. | 446/184 |
| 5,810,640 | A | | 9/1998 | Clarke et al. | 446/132 |
| 6,109,998 | A | * | 8/2000 | DiResta et al. | 446/184 |
| 6,112,703 | A | * | 9/2000 | Handelsman | 119/707 |
| 6,224,517 | B1 | * | 5/2001 | Dereszynski | 482/105 |

* cited by examiner

*Primary Examiner*—Derris H. Banks
*Assistant Examiner*—Urszula M Cegielnik
(74) *Attorney, Agent, or Firm*—Caesar, Rivise, Bernstein, Cohen & Pokotilow, Ltd.

(57) ABSTRACT

A noise making toy for making a gurgling sound to imitate a bodily function is provided having a rigid, hollow and elongate tube sealed at each end by an elastically expansible flexible bladder. The elongate tube and the bladders define an inner volume that is sealed from an ambient outside environment and filled with a combination of a highly viscous, gel-like material and a gas, whereby when one of the flexible bladders is squeezed, the highly viscous gel-like material and the gas are forced through the elongate tube thereby creating a gurgling sound.

35 Claims, 3 Drawing Sheets

NOISE MAKING TOY

BACKGROUND OF THE INVENTION

This invention relates generally to the field of toys, and in particular to noise making toys.

The general concept of noise making toys that make sounds imitating various human bodily functions is well known. For example, in U.S. Pat. No. 5,577,723, a squeezable toy ball is provided which simulates the appearance of a human organ which, when squeezed, generates a gurgling sound similar to that of a functioning organ. Likewise, U.S. Pat. No. 5,759, 682 provides for a similar toy that simulates an object such as a human organ, body part, or the entire humanoid figure. In these inventions, when the object is squeezed, air and fluid are ejected from an orifice in its core into irregular spaces within the core. The core's surface is: contoured to define the organ or figure. A transparent film casing encloses the organ or figure. When the object is released to cause the organ or figure to resume its normal appearance, the air and fluid are sucked back into the hollow core thereby producing the gurgling sounds.

Other patents provide various dolls that produce sound effects of bodily functions. For example, U.S. Pat. No. 4,917,645 provides a doll having a mechanical device that includes a bladder that simulates the sound of an infant burping. Likewise, U.S. Pat. No. 4,160,338 provides a doll that includes a mechanical device which creates a burping sound.

None of these devices is designed with a primary goal of producing a bodily function sound in an optimized manner without concern for simulating another object in form. The '723 patent provides a ball to be used as an ordinary ball. The '682 patent provides a toy that simulates an organic object such as a human organ. The present device has been optimized in an attractive form primarily to create a desired sound in a most efficient manner, without the desire to simulate another form such as a ball, a doll, or a human organ.

OBJECTS OF THE INVENTION

Accordingly, it is a general object of the present invention to provide a toy that produces a gurgling sound to imitate the sound of a bodily function which overcomes the disadvantages of the prior art.

It is therefore an object of the present invention to provide a toy that produces a gurgling sound to imitate the sound of a bodily function, where the form of the object is optimized to present the desired sound in a most realistic manner.

It is a further object of the present invention to provide a toy that, when manipulated by a user's hands, produces a gurgling sound to imitate the sound of a bodily function.

It is still a further object of the present invention to provide a toy that when manipulated by a user's hands, produces a gurgling sound to imitate the sound of a bodily function, that is attractive to play with by children and adults.

It is yet another object of the present invention to provide a toy that produces a gurgling sound to imitate the Sound of a bodily function that is inexpensive to manufacture.

It is still another object of the present invention to provide a toy that produces a gurgling sound to imitate the sound of a bodily function that may be assembled from components easily and economically and which will exhibit long life.

Other objects and many attendant features of this invention will become readily appreciated as the same becomes better understood by reference to the following detailed description when considered in connection with the accompanying drawings.

SUMMARY OF THE INVENTION

These and other objects of this invention are achieved by providing a toy that produces a gurgling sound to imitate the sound of a bodily function. The preferred embodiment of the toy includes a rigid, hollow and elongate tube, sealed at each end by an elastically expansible flexible bladder. The elongate tube and the bladders define an inner volume that is sealed from the ambient outside environment and filled with a combination of a highly viscous, gel-like material and a gas, whereby when one of the flexible bladders is squeezed, the highly viscous gel-like material and the gas are forced through the elongate tube thereby creating a gurgling sound.

DETAILED DESCRIPTION OF THE PREFERRED EMBODIMENT

Figure 1:
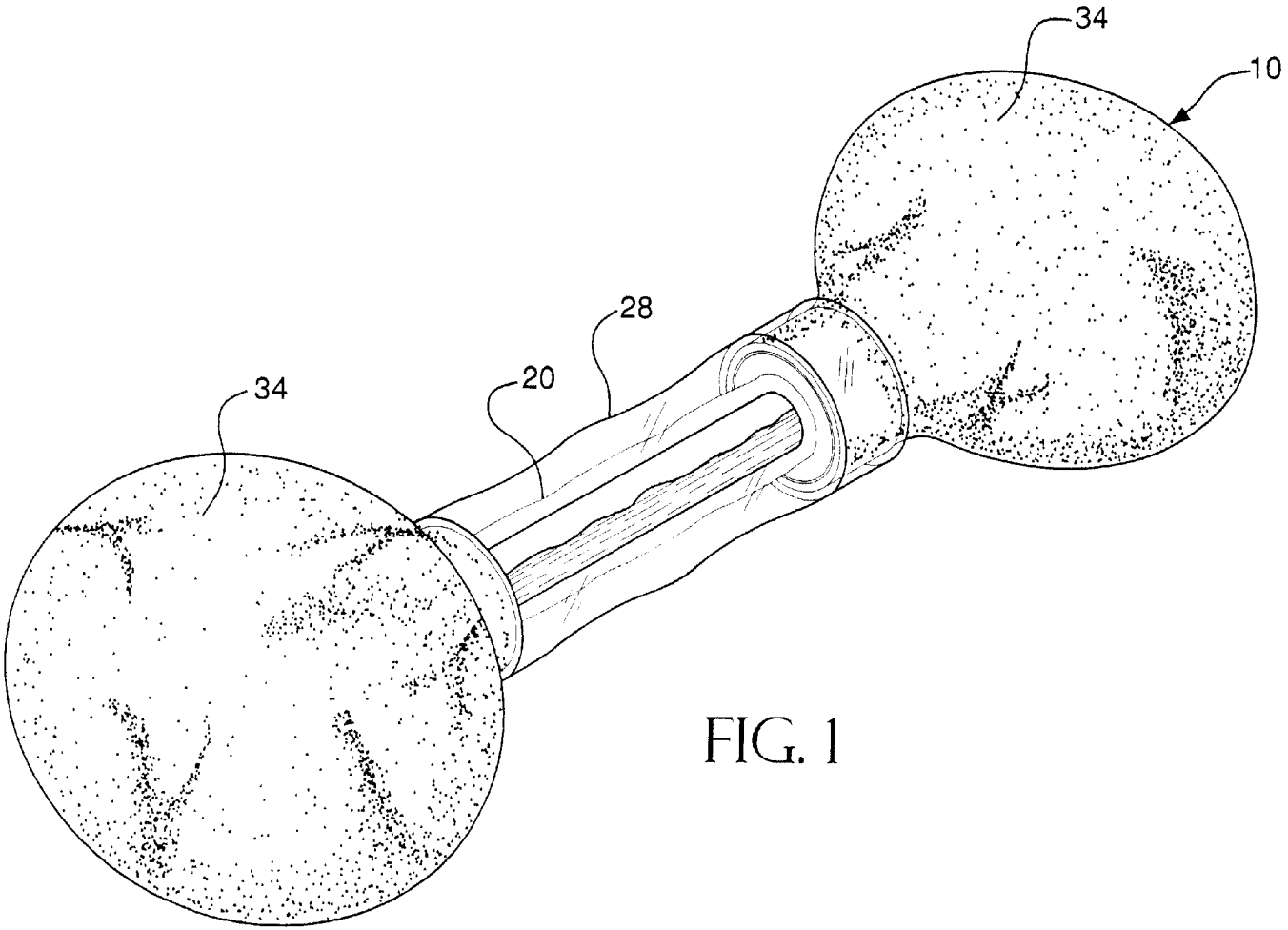
FIG. 1 is an isometric view of a noise making toy for making a gurgling sound in accordance with.one preferred embodiment of the present invention.
Figure 2:
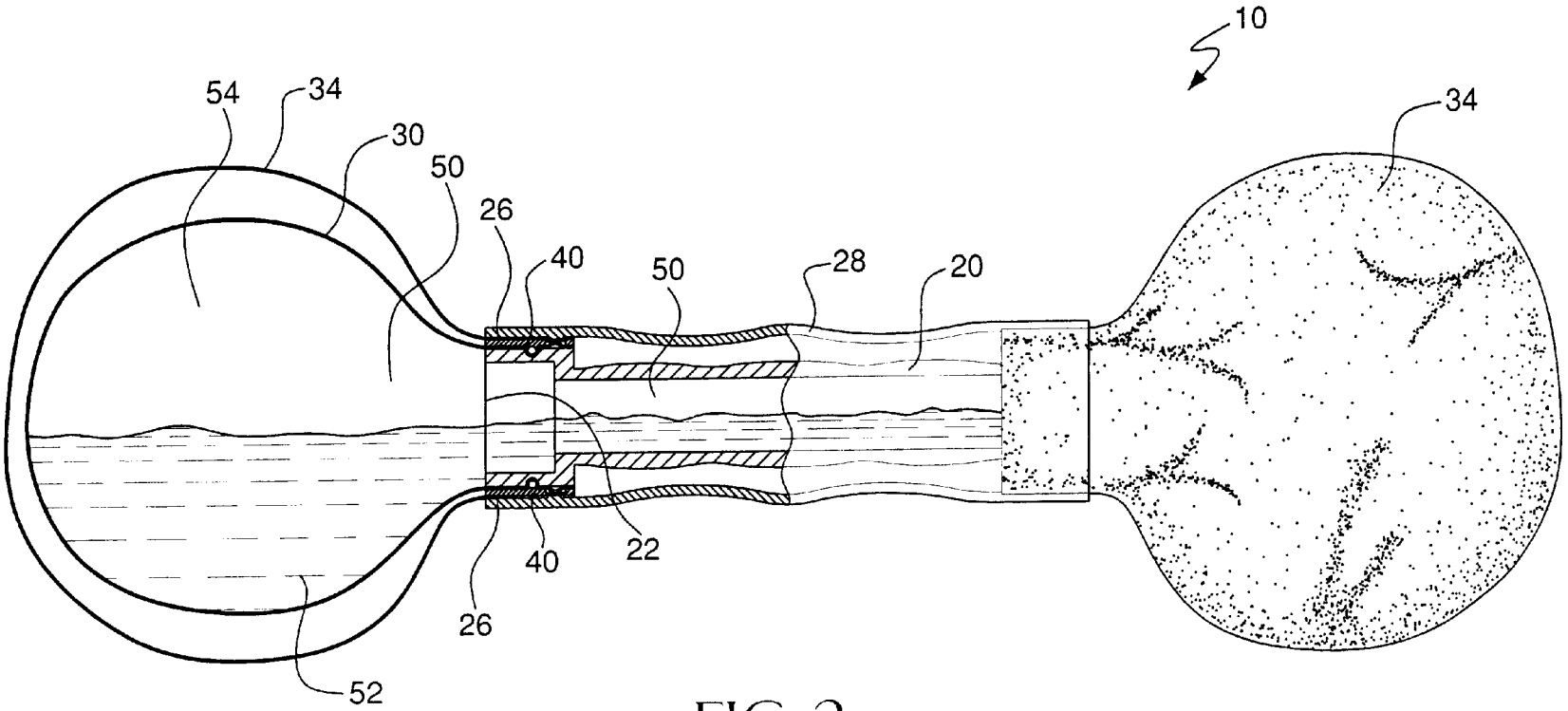
FIG. 2 is a partially cutaway, front elevational view of the noise making toy of FIG. 1.
Figure 3:
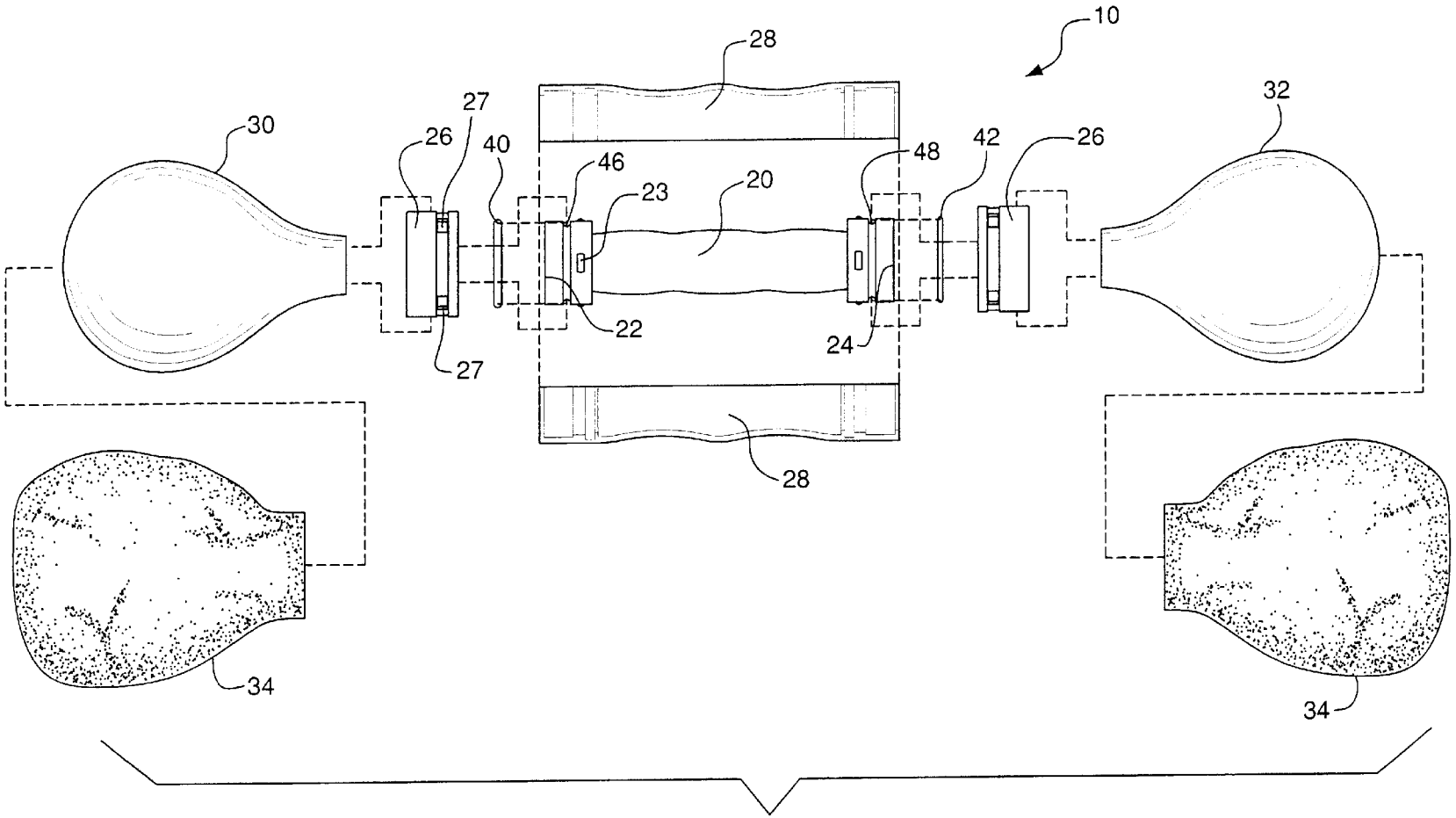
FIG. 3 is an exploded front elevational view of the noise making toy of FIG. 1.

Referring now to the various figures of the drawing wherein like reference numbers refer to like parts throughout the several views, there is shown in FIGS. 1 through 3 a noise making toy for making a gurgling sound 10 in accordance with one preferred embodiment of the present invention. The noise making toy 10 generally includes a rigid hollow elongate tube 20 having open, opposed ends 22, 24. The elongate tube 20 is sealed at each opposed end 22, 24 by a first and a second to elastically expansible flexible bladder or balloon-like device 30, 32 (see FIGS. 2 and 3) such that liquids and gases.are permanently contained within the elongate tube 20 and bladders 30, 32. Preferably O-rings 40, 42 surround an end of each bladder 30, 32 connecting each bladder 30, 32 to slots 46, 48 in the elongate tube 20. The elongate tube 20 and the bladders 30, 32 create an inner volume 50 closed to the ambient outside environment, preferably in a barbell shape (see FIGS. 1 and 2) with the two bladders 30, 32 forming substantially spherical ends connected by the elongate tube 20.

The inner volume 50 is partially filled with a water based, highly viscous, gel-like material 52 (and water as necessary to obtain the desired gel-like material consistency) with the remainder filled with a gas 54, preferably air, such that the inner volume is entirely filled and preferably somewhat pressurized by the gas 54, with at least enough pressure to minimally fill the bladders 30, 32 without causing the excessive expansion of the bladders 30, 32. See FIG. 2.

Although, a wide range of quantities of the highly viscous gel-like material 52 in combination with a gas such as air would provide for proper operation of the noise making toy 10, a preferable quantity of the highly viscous gel-like material 52 (and water as necessary) applied to the inner volume 50 would fill slightly less than half of the total inner volume 50. Such a volume of the gel-like material 52, and water as necessary, in combination with the gas inserted therein creates the desired "gurgling" effect of the device, as will be detailed below. The ratios of highly viscous gel-like material, water, and gas can easily be determined by routine experimentation by a person skilled in the art, depending upon the sound that is desired to be produced. Due to the variable nature of the highly viscous gel-like materials currently on the market, an exact ratio of these materials cannot be provided for all cases. However, as indicated above, the highly viscous gel-like material is preferably water based such that the proper consistency can be created by remixing the gel-like material with water until desired and consistent properties are obtained.

The highly viscous gel-like material 52 may be, for example, similar to a play material previously manufactured and sold by Mattel, Inc. under the trademark "Slime". A formula for a similar material is taught, for example, by U.S. Pat. No. 5,310,421. Of course, due to the nature of the present invention, all elements of the present invention, including the gel-like material 52, are preferably non-toxic.

In this preferred embodiment, the bladders have a diameter of approximately four inches, the inner diameter of the rigid hollow tube is approximately one-half inch and the length of the inner tube is approximately four inches. Obviously the dimensions of the noise making device 10 can vary substantially and still operate satisfactorily in accordance with the present invention. In this example, approximately 125 ml of the gel-like material and 45 ml of water has performed satisfactorily.

The bladders 30, 32 are preferably fabricated from latex or other rubber-like material and attached to the elongate tube 20 with the O-rings 40, 42. An outer annular flange 26 is preferably placed over each bladder 30, 32 and O-ring 40, 42 to further secure the bladders 30, 32 to the rigid hollow tube 20. This flange 26 may be held in place, for example, by friction utilizing tab 23 on elongate tube 20 mating with holes 27 on the outer annular flange 26.

Additionally, an optional two-piece outer protective housing 28 is employed to provide for secondary protection for the noise making toy 10. Preferably, the outer protective housing 28 and the elongate tube 20 are fabricated from a clear plastic to allow a user to visually observe the highly viscous gel-like material 52 flowing back and forth in the elongate tube 20. Ultrasonic welds may be used to hold the outer protective housing 28 together and in place on the assembly. Preferably, the highly viscous gel-like material 52 is colored using a conventional colorant that may be transparent neon or glow-in-the dark, to enhance the visual effect of the device.

The inner surface of the elongate tube 20 preferably has a uniform circular cross-section. However, undulating surfaces, where the cross-section varies, or other irregularities in the cross section of the elongate tube 20 may create different and desirable sound effects.

Optionally, the bladders 30, 32 may have an outer covering 34 made from a stretchable fabric perhaps of bright and appealing colors. This fabric may be patterned or imprinted with, for example, advertising indicia, trademarks, or the like.

In the preferred use, a user of the noise making toy 10 grasps one of the two bladders 30 in the left hand and the other of the two bladders 32 in the right hand, holding the noise making toy 10 in approximately a horizontal position. The user then alternately squeezes the bladders 30, 32 thereby forcing a portion of the gel-like material 52 and gas 54 back and forth between the two bladders 30, 32 through the elongate tube 20. The combination of gel-like material 52 and gas 54 simultaneously being forced through the elongate tube 20 by squeezing one bladder 30 through the elongate tube 20 and then into the other bladder 32 creates relatively large gas voids in the gel-like material 52 within the elongate tube 20 such that the gas 54 and gel-like material 52 are forcefully expelled into the second bladder. The movement of the gel-like material 52 and the gas 54 within the rigid hollow tube creates the desired gurgling sound.

Additionally, in the preferred embodiment, the inner volume 50 of the noise making toy 10 is preferably slightly pressurized with the gas. When the user squeezes one of the two bladders 30, a portion of the gel-like material 52 and gas 54 are forced through the elongate tube 20 into the other of the two bladders 32 causing that bladder 32 to expand and the desired sound to be produced. When the first of the two bladders 30 is released, a portion of the gel-like material 52 and gas 54 is forced in the opposite direction as the device equalizes in pressure, back through the elongate tube 20 and into the first bladder 30 thereby.again causing the desired sound to be produced. As indicated above, a user could also use both hands to alternately squeeze one or the other of the bladders 30, 32 such that the gel-like material 52 and gas 54 flow back and forth between the two bladders 30, 32 creating the desired sound.

Alternate embodiments may have other than the two bladders of the present invention. Additionally, only one bladder may be required, so long as a reservoir that is not necessary flexible is included such that the gel-like material water, and the gas can move through a rigid hollow tube.

Additionally, in alternate embodiments, the elongate tube need not necessarily be straight, but could be curved, helical or any of numerous other desired configurations.

Without further elaboration, the foregoing will so fully illustrate our invention that others may, by applying current or future knowledge, readily adopt the same for use under various conditions of service.

We claim:

1. A noise making toy for making a gurgling sound to imitate a bodily function, said toy comprising a rigid, hollow, elongate tube having two opposed ends, said elongate tube sealed at each opposed end by an elastically expansible flexible bladder, said elongate tube and said bladders defining an inner volume, said inner volume sealed from an ambient outside environment by said elongate tube and said bladders and filled with a combination of a highly viscous, gel-like material and a gas, whereby when one of said flexible bladders is squeezed, said highly viscous gel-like material and said gas.are forced through said elongate tube thereby creating a gurgling sound.

2. The noise making toy for making a gurgling sound of claim 1, wherein said flexible bladders each have an outer covering.

3. The noise making toy for making a gurgling sound of claim 1, wherein said flexible bladders each have an outer covering having printed indicia thereon.

4. The noise making a gurgling sound of claim 1, wherein said elongate tube includes an inner surface having a variable cross-section creating an undulating surface.

5. The noise making toy for making a gurgling sounds of claim 1, wherein said elongate tube has a circular cross section.

6. The noise making device for making a gurgling sound of claim 1, wherein said gel-like material is included to partially fill said inner volume and said gas is added to completely fill a remaining portion of said inner volume without elastically expanding said bladders.

7. The noise making-device for making a gurgling sound of claim 1, wherein said gel-like material is dyed with a colorant.

8. The noise making device for making a gurgling sound of claim 1, wherein said elongate tube is clear plastic.

9. The noise making device for making a gurgling sound of claim 1, including an outer protective housing rigidly attached to said elongate tube.

10. The noise making device for making a gurgling sound of claim 1, wherein said gel-like material contains a quantity of water to regulate consistency of said gel-like material.

11. The noise making device for making a gurgling sound of claim 1, wherein said gel-like material fills approximately half said inner volume and said gas fills a remaining portion of said inner volume.

12. The noise making device for making a gurgling sound of claim 1, wherein said gas is a compressed gas.

13. A noise making toy for making a gurgling sound to imitate a bodily function comprising at least one flexible bladder, a rigid tube, and a least one reservoir, said at least one bladder, said tube and said reservoir forming an inner volume closed to ambient outside environment, said inner volume filled with a highly viscous gel-like material and gas, said at least one bladder and said reservoir sealingly connected to said at least one flexible bladders is squeezed, said highly viscous gel-like material and said gas forced through said tube thereby creating a gurgling sound.

14. The noise making device for making a gurgling sound of claim 13, wherein said reservoir is a flexible bladder.

15. The noise making device for making a gurgling sound of claim 13, wherein said tube is elongate.

16. The noise making toy for making a gurgling sound of claim 13, wherein said at least one flexible bladder has an outer covering.

17. The noise making toy for making a gurgling sound of claim 13, wherein said at least one flexible bladder has an outer covering having printed indicia thereon.

18. The noise making toy for making a gurgling sound of claim 13, wherein said tube has an inner surface having a variable cross-section creating an undulating inner surface.

19. The noise making toy for making a gurgling sound of claim 13, wherein said tube has a circular cross section.

20. The noise making device for making a gurgling sound of claim 13, wherein gel-like material is included to at least partially fill said inner volume and said gas is added to completely fill a remaining portion of said inner volume without elastically expanding said at least one bladder.

21. The noise making device for making a gurgling sound of claim 13, wherein said gel-like material is dyed with a colorant.

22. The noise making device for making a gurgling sound of claim 13, wherein said elongate tube is clear plastic.

23. The noise making device for making a gurgling sound of claim 13, including an outer protective housing rigidly attached to said elongate tube.

24. The noise making device for making a gurgling sound of claim 13, wherein said gel-like material contains a quantity of water to regulate consistency of said gel-like material.

25. The noise making device for making a gurgling sound of claim 13, wherein said gel-like material fills approximately half said inner volume.

26. The noise making device for making a gurgling sound of claim 13, wherein said gas is a compressed gas.

27. A noise making toy for making a gurgling sound to imitate a bodily function, comprising a rigid, hollow, elongate tube having two opposed ends and a circular cross section, said elongate tube sealed at each opposed end by an elastically expansible flexible bladder, said elongate tube and said bladders defining an inner volume, said inner volume sealed from an ambient outside environment by said elongate tube and said bladders and filled with a combination of a highly viscous, gel-like material and a gas, said gel-like material containing a quantity of water to regulate consistency of said gel-like material, said gel-like material included to partially fill said inner volume and said gas added to completely fill a remaining portion of said inner volume without elastically expanding said bladders, whereby when one of said flexible bladders is squeezed, said highly viscous gel-like material and said gas are forced through said elongate tube thereby creating a gurgling sound.

28. The noise making toy for making a gurgling sound of claim 27, wherein said flexible bladders each have an outer covering.

29. The noise making toy for making a gurgling sound of claim 27, wherein said flexible bladders have an outer covering having printed indicia thereon.

30. The noise making toy for making a gurgling sound of claim 27, wherein said elongate tube includes an inner surface having a variable cross-section creating an undulating inner surface.

31. The noise making device for making a gurgling sound of claim 27, wherein said gel-like material is dyed with a colorant.

32. The noise making device for making a gurgling sound of claim 27, wherein said elongate tube is clear plastic.

33. The noise making device for making a gurgling sound of claim 27, including an outer protective housing rigidly attached to said elongate tube.

34. The noise making device for making a gurgling sound of claim 27, wherein said gel-like material fills approximately half said inner volume.

35. The noise making device for making a gurgling sound of claim 27, wherein said gas is a compressed gas.

* * * * *